United States Patent [19]

Blum et al.

[11] Patent Number: 4,502,680

[45] Date of Patent: Mar. 5, 1985

[54] FOOT EXERCISER

[76] Inventors: Alvin S. Blum, 2350 Del Mar Pl., Fort Lauderdale, Fla. 33301; James W. Dickey, Jr., 3018 N. Atlantic Blvd., Fort Lauderdale, Fla. 33308

[21] Appl. No.: 452,766

[22] Filed: Dec. 23, 1982

[51] Int. Cl.[3] ..... A61H 1/02

[52] U.S. Cl. ..... 272/96; 272/136; 272/DIG. 5; 272/900

[58] Field of Search ..... 272/93, DIG. 5, 70, 272/96, 94, 900, 135, 136

[56] References Cited

U.S. PATENT DOCUMENTS

| | | | |
|---|---|---|---|
| 3,022,071 | 2/1962 | Malone et al. | 272/96 |
| 3,741,540 | 6/1973 | Shimizu | 272/96 |
| 3,784,194 | 1/1974 | Perrine | 272/DIG. 4 |
| 4,204,675 | 5/1980 | McGinnis | 272/70 |
| 4,216,956 | 8/1980 | Yamamura et al. | 272/DIG. 5 |
| 4,294,236 | 10/1981 | Hofstein | 272/DIG. 5 |

FOREIGN PATENT DOCUMENTS

| | | | |
|---|---|---|---|
| 2707604 | 8/1978 | Fed. Rep. of Germany | 272/96 |

*Primary Examiner*—Richard C. Pinkham
*Assistant Examiner*—Leo P. Picard
*Attorney, Agent, or Firm*—Alvin S. Blum

[57] ABSTRACT

An improved foot exercising device having pedals pivotally secured to a support. Leg exercise can be obtained by regularly pumping pedals up and down. A control system registers number of pumping motions and signals user when an inadequate number of motions has been registered in a particular time period. A control regulates the amplitude of motion to ensure adequate contraction and relaxation of the leg muscles. The combination satisfies the physiological requirements to prevent dependent edema in seated users. A wheelchair application is disclosed.

20 Claims, 9 Drawing Figures

FOOT EXERCISER

This invention relates to an improved foot exercising device.

Prior art including U.S. Pat. Nos. 3,022,071; 3,421,761; 3,525,522; 3,526,220; 3,741,540; 3,917,261; 4,111,416 and 4,204,675 describe devices for exercising the foot and leg muscles which have met with only limited degrees of acceptance.

The exerciser of the present invention is designed primarily to promote the circulation of blood and lymph through the lower portion of the body by encouraging particular periodic motions of the foot and ankle. These motions involve the alternate contraction and relaxation of the muscles of the lower leg. These alternating muscular actions propel or pump blood and lymph from the lower limb toward the heart. This function becomes especially important when the feet are below the heart as in standing or sitting.

Many individuals suffer from accumulation of fluid in the lower limbs (dependent edema) when sitting for prolonged periods with the feet down (dependent), because this pumping action is absent for too long a period of time. It is an object of the present invention to provide apparatus to encourage the requisite motion and to encourage the requisite periods of operation.

The construction of the device of the invention in its preferred embodiments and the manner through which the desired results are secured will be best understood by reference to the accompanying drawings wherein.

Figure 1:
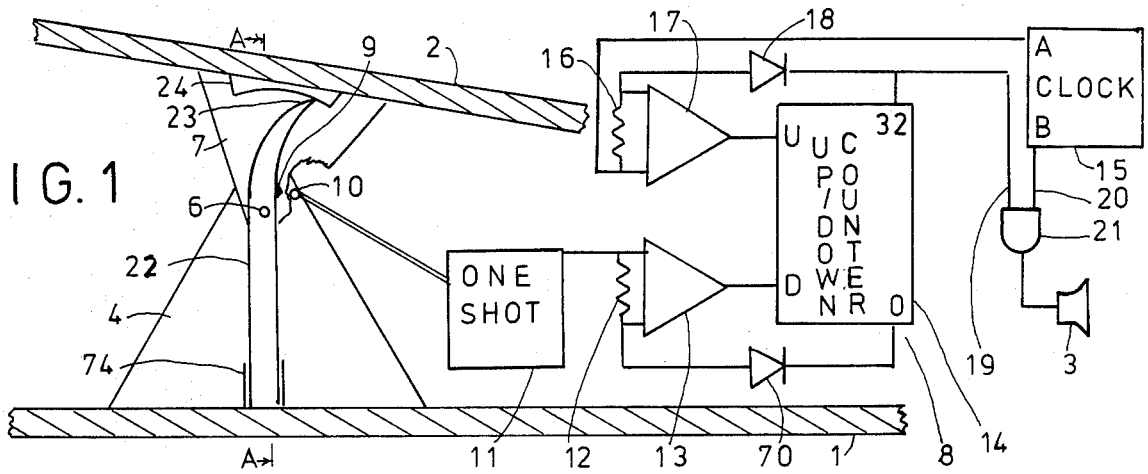
FIG. 1 is a sectional view of a device of the invention, part broken away.
Figure 2:
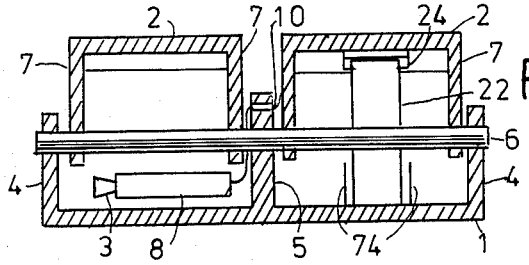
FIG. 2 is a sectional view through the pivot of the device of FIG. 1.
Figure 9:
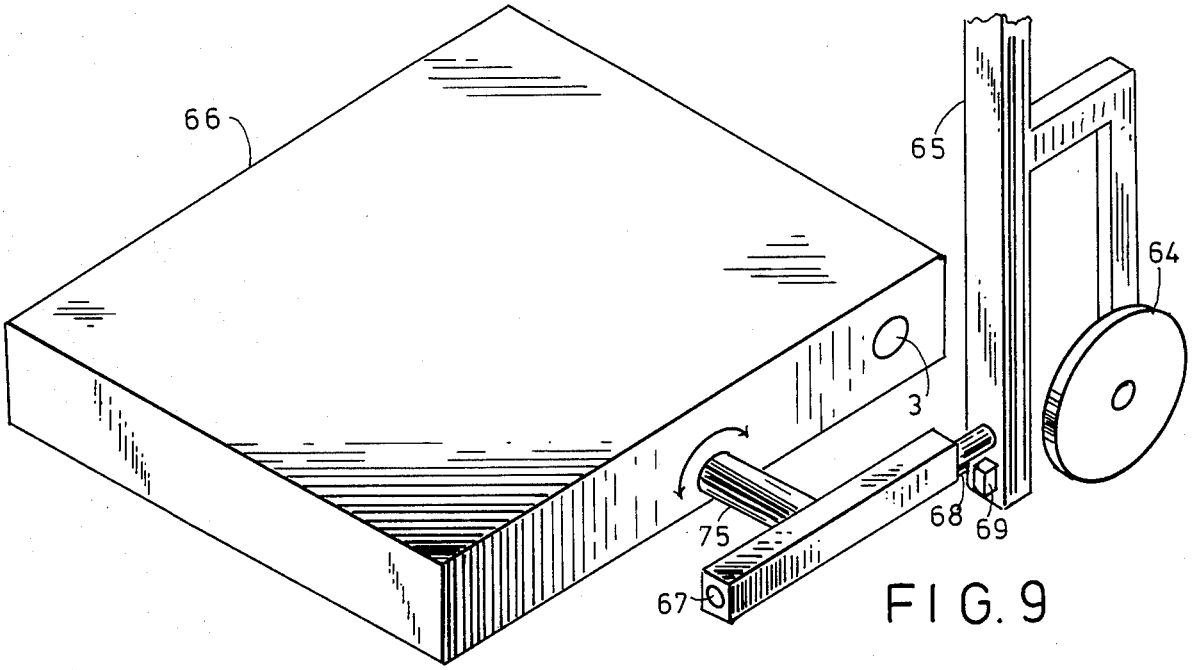
FIG. 9 is a perspective view of a wheelchair pedal embodying the invention.

The foot exerciser of the present invention comprises essentially a base support 1 holding one or two pedals 2. Joining fittings may be provided at the end junction between base 1 and pedal 2 as shown in FIGS. 3,5,6, and 7 to allow an up and down swinging motion like a hinge or otherwise they may be provided at the middle portions of the pedal as shown in FIGS. 1, 2 and 9 so as to make said pedal 2 movable up and down in the manner of a seesaw. Middle pivoting has the advantage of not requiring a return spring. It has the disadvantage of requiring elevation of the heel which may be awkward for users wearing high heals.

Figure 4:
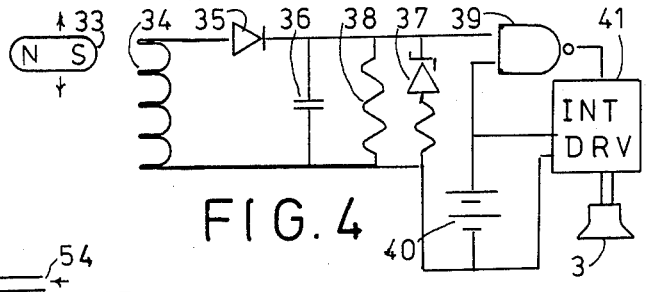
FIG. 4 is a diagram of an analog electronic circuit of the invention.
Figure 8:
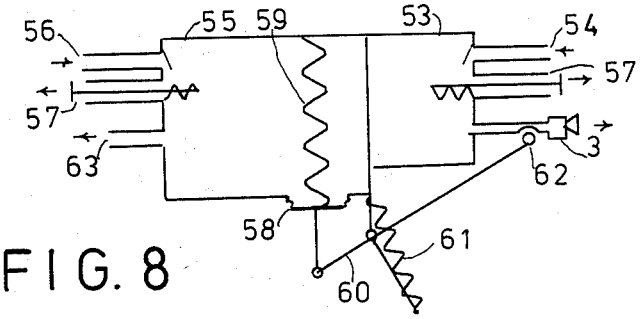
FIG. 8 is a sectional view of a pneumatic control of the invention.
Figure 7:
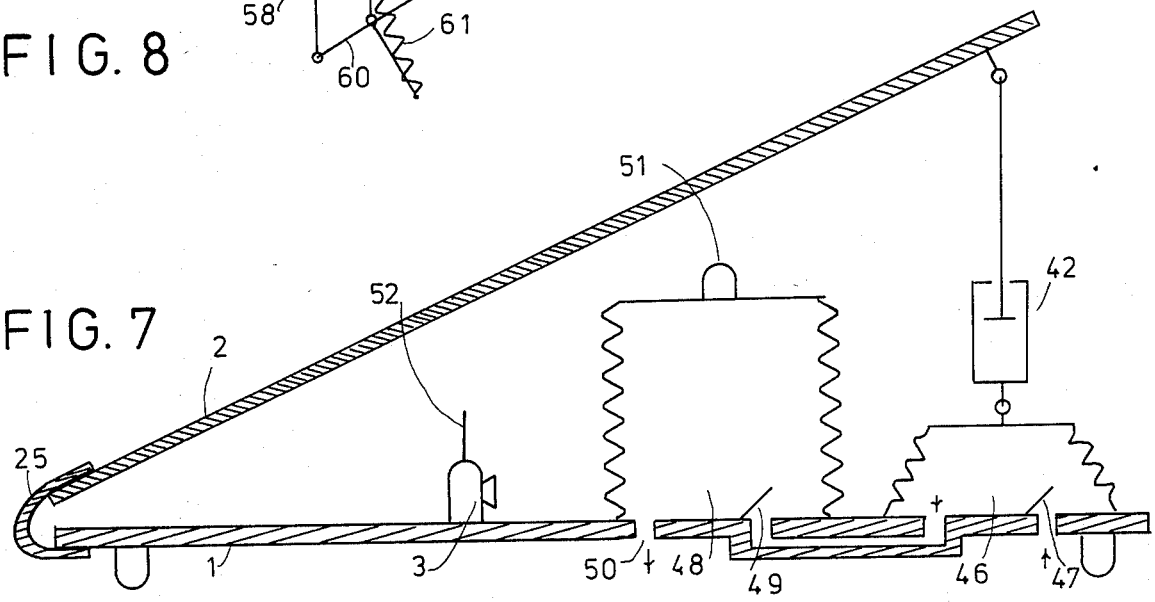
FIG. 7 is a sectional view of a pneumatic embodiment of the invention.

In order to effectively circulate fluid in the leg and foot, a certain number of muscular contractions and relaxations may be required in a particular time interval. The invention provides a counting/timing mechanism to encourage these periodic muscular actions by registering each pedal excursion and signalling to the user when there is a deficiency in the number of excursions in a time period. A digital counting/timing mechanism is shown in FIGS. 1,2. An analog electronic counting-/timing mechanism is shown in FIG. 4. Pneumatic counting/timing mechanisms are shown in FIGS. 7 and 8. Audible signal devices 3 are shown, but other signal devices, such as visible may be provided.

Figure 3:
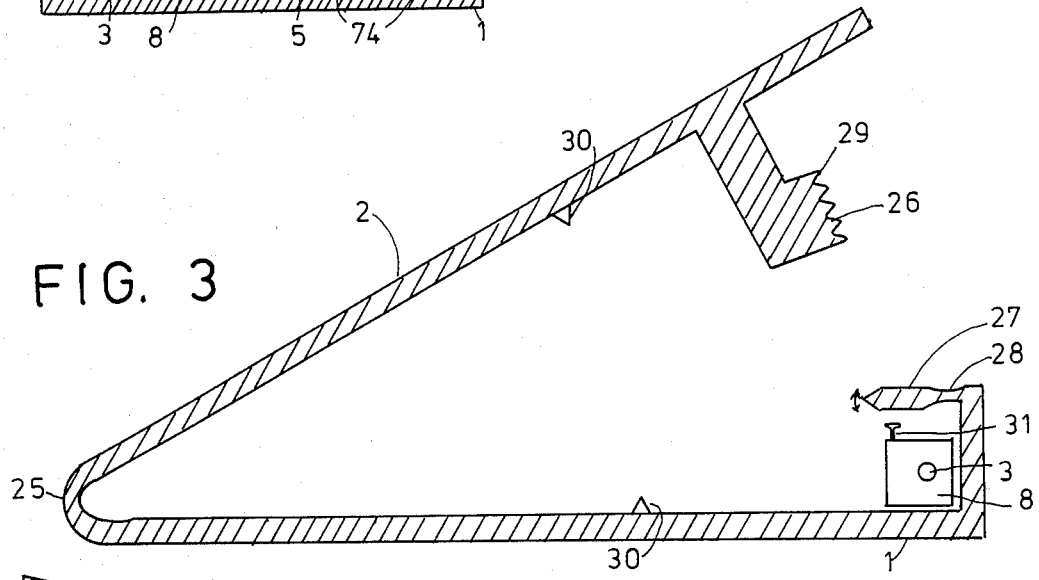
FIG. 3 is a sectional view of another embodiment of the invention.

In order to effectively circulate fluid in the leg and foot by muscular contractions and relaxations involving the operation of a pedal, a certain amplitude of pedal motion or excursion may be required. FIGS. 1,2 and 3 show two ratchet type stroke amplitude regulating devices. With these devices, motion in one direction must be continued in that direction past a certain point before the return motion can be made. These devices provide a second advantage in that the stroke amplitude regulating mechanism also holds the pedal fixedly at an angle thereby serving the function of an adjustable angle footrest. Both the foot exerciser and adjustable footrest functions are useful to users such as office workers who spend prolonged periods seated. The stroke amplitude regulating devices of FIGS. 5,6 and 7 function by requiring a certain pedal excursion amplitude in order to register a stroke into the counting/timing mechanism.

In FIG. 1, the ends of the base 1 and pedal 2 and a portion of pedal side plate 7 have been broken away. The digital electronic counting/timing mechanism 8 is shown schematically. A shaft 6 is fixedly supported by end supports 4 and center support 5 of base 1. A pair of pedals 2 are mounted for rocking or tilting movement upon shaft 6 by pedal side plates 7 journalled to shaft 6. Tilting of pedal 2 causes magnet 9 mounted on pedal side plate 7 to actuate reed switch 10 mounted on support 4 as it swings past it. A projection could actuate a mechanical switch as well. Switch 10 is connected to one shot multivibrator (univibrator) 11. Switch actuation generates a pulse output from the univibrator and across input resistor 12 of buffer amplifier 13 providing a down pulse to up/down counter 14. Clock 15 supplies one positive output pulse at A every minute and one positive output pulse at B every 5 minutes. The pulse at A is across input resistor 16 of buffer amplifier 17 providing an up pulse to up/down counter 14. When counter 14 reaches a total count of 32, output 32 goes positive, biasing diode 18 positive so that clock pulses from output A don't produce a pulse across resistor 16 and therefor don't count. When output 32 is positive, first input 19 to AND gate 21 is positive and positive pulse B from clock 15 at second input 20 of gate 21 causes a positive output of the gate enabling the audible signal 3. A signal will sound every 5 minutes (pulse rate at B output of clock) until user operates the pedal 2 sending down pulses into the up/down counter 14, reducing the count below 32. When the counter 14 reaches zero from repeated pedal strokes, output O of counter 14 goes positive, biasing diode 70, so that no pulses appear across resistor 12 when switch 10 actuates. Numbers other than zero and 32 may be selected for outputs from counter 14. In operation, if pedal is idle for more than 32 minutes, a signal will sound every 5 minutes until pedal motion of requisite amplitude is begun. Each pedal stroke will ensure one minute of silence, and 32 pedal strokes will ensure 32 minutes of silence. More than 32 strokes in a burst will still only give 32 minutes of silence, because one can only store the circulatory benefit of exercise for a limited period. And 32 strokes in any combination every 32 minutes will ensure continued silence. An on-off switch may be provided to disable the device when user is away. The switch may be a spring loaded on-off switch actuated by the weight of the user's feet. When the device is switched on, we may assume the user walked to the chair, and is credited with 32 minutes rest before he is warned to exercise again. FIG. 2 is a sectional view thru line A—A of FIG. 1. However, switch 10 is now shown in the center support 5, where it can be actuated by magnets from both pedals. In FIG. 1 a separate counting/timing mechanism would operate for each pedal and in FIG. 2 both pedals share a counting/timing mechanism. The stroke amplitude regulating mechanism comprises a rubbery vertical member 22, held in place by shaft 6 and base holder 74, whose wedge shaped tip 23 bears against, and is bent by the arcuate projection 24 on the underside of pedal 2. The surface of projection 24 against which member 22 presses is serrated so as to provide a rachet effect. As shown, the pedal is rotating clockwise and counter clockwise rotation is prevented by the wedging action of tip 23 against the surface of projection 24. When clockwise rotation has continued to the extent that tip 23 has passed the left side of projection 24, then the tip 23 can straighten out and then counter clockwise rotation causes the tip to bend in the opposite direction, thereby reversing the ratcheting mechanism, which now will resist clockwise rotation until the other limit of excursion is reached. The amplitude regulating mechanism is only shown in one pedal of FIG. 2 for clarity of illustration. The rubbery member 22 may be replaced by a spring loaded pivoted pawl ratchet mechanism well known in the art.

An embodiment of the invention illustrated in FIG. 3 may have all of the mechanical elements exclusive of electronics molded in one piece. The base 1 and pedal 2 are joined by an articulation 25 which serves as a spring and hinge. Pressure on the pedal causes gear teeth 26 to impinge upon pawl 27 forcing it downward and tensing pawl spring 28. As pawl clicks over gear teeth, ratcheting action prevents pedal 2 from springing up in return motion until pedal downstroke has caused uppermost gear tooth 29 to pass pawl 27. At that time, pawl spring 28 forces pawl 27 to horizontal position and pedal 2 is free to rise when foot pressure is relaxed. As pedal rises, pawl 27 is forced upward and clicks over gear teeth in reverse ratcheting action. In addition to regulation of stroke amplitude, this serves as adjustable angle footrest because pressure on the pedal cannot force pedal down in this condition by action of pawl 27 against gear teeth 26. If spring strip hinge 25 is not powerful enough for return force, a compression spring may be mounted between spring mount points 30. Every downstroke of pawl 27 actuates switch 31 of digital electronic counter/timer mechanism 8 provided with audible signal 3 as described above.

FIG. 4 is a schematic diagram of an analog electronic counter timer mechanism of the invention. Pedal motion moves magnet 33 past coil 34 generating a positive pulse across capacitor 36. Negative pulse generated by the return motion is blocked by diode 35. Each pulse adds an incremental charge on capacitor 36 until a maximum value, determined by zener diode 37 is reached. Bleeder resistor 38 slowly drains the accumulated charge off capacitor 36. Battery 40 maintains a first input to NAND gate 39 positive. When charge on capacitor 36 is great enough to maintain second input to NAND gate high, interval driver 41 is cut off and audible signal 3 is off. When second input is low because charge on capacitor 36 has bled off and no recent pedal motion has been input, driver 41 is enabled and audible signal sounds once every 5 (adjustable) minutes. The mechanism of pedal motion moving a magnet past a coil may be used to recharge a battery making the device independent of outside power.

Figure 5:
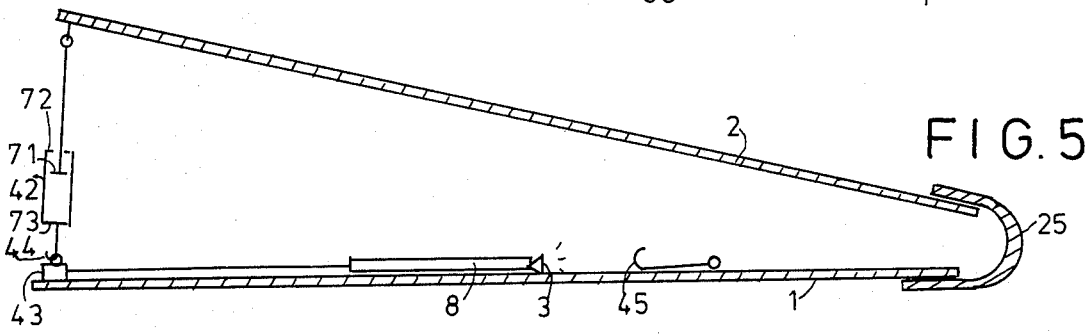
FIG. 5 is a sectional view of a collapsible embodiment of the invention in open condition.
Figure 6:
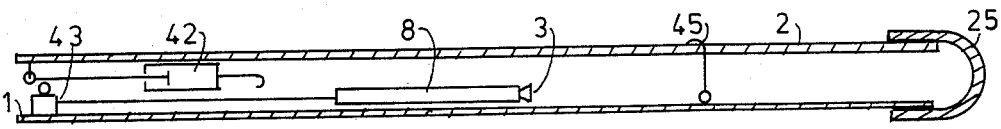
FIG. 6 is a sectional view of the device of FIG. 5 in closed condition.

FIGS. 5 and 6 show a portable exerciser of the invention. A strip spring hinge 25 may alternatively be replaced by a pivoted articulation and compression spring well known in prior art. A mechanical stroke amplitude regulating mechanism 42 requires a particular amount of pedal travel before pedal motion actuates switch 43 which controls counter/timer mechanism 8 and audible signal 3. Bar 71 travels free between upper stop 72 and lower stop 73 without transmitting motion. For portability, the open mode of FIG. 5 is converted to the closed mode of FIG. 6 by unsnapping latch 44 which connects stroke regulator 42 to switch 43, pressing closed, and fastening closed with closure hook 45.

In the embodiment of FIG. 7, the stroke amplitude regulating mechanism 42 is connected to small air pump 46 with one way air inlet valve 47. Each effective pedal stroke pumps a small volume of air into air reservoir 48 through one way inlet valve 49. When reservoir 48 is sufficiently full, it prevents user from depressing pedal enough to pump and maximum stroke count has been reached. Air leak 50 lets air escape slowly from reservoir 48 under force of weight 51. When enough air has leaked out of reservoir 48, pressure on pedal lowers pedal 2 enough to actuate control lever 52 of audible signal generator 3. This may be an electric horn or a simple pnaumatic squeeker such as a child's squeeze toy. That embodiment would require no battery power.

A more sophisticated pneumatic counter/timer signal mechanism is illustrated in FIG. 8. The pumping action of the pedal fills a first (power) air chamber 53 through inlet 54 and a second (control) air chamber 55 through inlet 56. Each reservoir has a spring loaded pressure relief valve 57. When pressure in control chamber 55 is high enough, diaphragm 58 is pushed out, stretching tension spring 59 and pushing lever 60 out enough so that toggle spring 61 snaps valve 62 closed. Small air leak 63 gradually leaks air out of reservoir 55. Unless more pumping occurs, pressure in chamber 55 will be reduced enough so that spring 59 will pull in diaphragm 58, and lever 60 and toggle spring 61 will snap valve 62 open. Compressed air in chamber 53 will escape through air whistle 3, signalling user to exercize.

Many people confined to wheelchairs could benefit from the present invention. The quality of their lives can be improved if they can avoid dependent edema by periodic ankle motion. Clamping structures may be provided on the base to fasten one of the above described embodiments of the invention onto the pedal of the wheelchair.

FIG. 9 shows a special wheelchair pedal incorporating the instant invention. The ordinary forward vertical member 65 supports a front wheel 64 and the pedal 66. In the usual fashion, pedal 66 swings up vertically around shaft 67 to allow easy access and egress from the chair. When swung down to the horizontal use position as shown, pin 68 hits against stop 69 to stabilize the down position. The improvement of the present invention comprises the mechanisms providing controlled tilting of pedal 66 around shaft 75. The pedal 66 is thicker than the usual pedal. It is hollow. Enclosed within the pedal are the above described mechanisms for stroke amplitude regulation and counter/timer and audible signal controller for audible signal 3. In addition to the exercizer function, this pedal, by virtue of its adjustable tilt properties, will be a far more comfortable footrest for those who must spend so many hours sitting in a wheelchair.

The above disclosed invention has a number of particular features which should preferably be employed in combination although each is useful separately without departure from the scope of the invention. Inasmuch as the invention is subject to many variations, modifications, and changes in detail, it is intended that all matter described above be interpreted as illustrative and not in a limiting sense.

What is claimed is:

1. An exerciser for improving fluid circulation, comprising: at least one foot pedal means; support means; joining means joining said pedal means to said support means pivotally to permit up and down motion strokes of the foot by flexion and extension of the ankle joint through contraction and relaxation of lower leg muscles; stroke counting means connected to said pedal means for accumulating information on the number of said strokes as accumulated stroke number information; reductive timing means connected to said counting means for reducing said accumulated stroke number information at a time related rate; signal means connected to said counting means for signalling to a user when the combined operation of said stroke counting means and said reductive timing means indicates that the number of said strokes that have been performed in a predetermined time interval is below a predetermined amount, said combined operation of said stroke counting means and said reductive timing means accumulating said motion strokes as they occur only up to a predetermined maximum number of accumulated strokes and reducing said accumulated stroke number of information at a predetermined rate of strokes.

2. The invention of claim 1, further comprising pedal motion amplitude regulating means interconnected between said pedal means and said stroke counting means, said pedal motion amplitude regulating means preventing a pedal stroke from accumulating unless it exceeds a predetermined amplitude of pedal motion.

3. The invention of claim 1, further comprising pedal motion amplitude regulating means connected to said pedal means, said pedal motion amplitude regulating means mechanically preventing up pedal motion until down pedal motion has passed a predetermined amplitude and preventing down pedal motion until up pedal motion has passed a predetermined amplitude of pedal motion.

4. The invention of claim 3, wherein said pedal motion amplitude regulating means includes a ratchet mechanism.

5. The invention of claim 3, including clamping means connected to said support means for clamping said exerciser to the pedal of a wheelchair.

6. The invention of claim 3, wherein said support means comprises an anterior support member of a wheelchair and said pedal means also serves as the wheelchair rest pedal.

7. The invention of claim 3, wherein said pedal means provides adjustable angle footrest means.

8. The invention of claim 1, wherein said stroke counting means and said reductive timing means are digital electronic circuits.

9. The invention of claim 1, wherein said stroke counting means and said reductive timing means are analog electronic circuits.

10. The invention of claim 1, wherein said stroke counting means and said reductive timing means are pneumatic.

11. The invention of claim 1, including audible signal means.

12. The invention of claim 1, including visible signal means.

13. The invention of claim 1, including spring loaded power switch means to disconnect power to said invention when foot weight is not resting thereon.

14. The invention of claim 1, wherein said joining means is a resilient member.

15. The invention of claim 14, wherein said resilient member is formed as an integral part of said pedal means and said support means.

16. A foot exerciser for improving circulation in the lower leg comprising: at least one foot pedal means; support means; joining means pivotally joining said pedal means to said support means to permit up and down motion strokes of the foot by flexion and extension of the ankle joint through contraction and relaxation of lower leg muscles; pedal motion amplitude regulating means mechanically preventing up pedal motion until down pedal motion has passed a predetermined amplitude of motion and preventing down pedal motion until up pedal motion has passed a predetermined amplitude of motion, said pedal motion amplitude regulating means thereby providing an adjustable angle footrest means when not in motion and also ensuring sufficient muscle action to maintain lymphatic circulation in the lower leg when the foot is put through said up and down motion strokes.

17. The invention of claim 16, including clamping means connected to said base means for clamping said exerciser to the pedal of a wheelchair.

18. The invention of claim 16, wherein said support means comprises an anterior support member of a wheelchair and said pedal means also serves as the wheelchair rest pedal.

19. The invention of claim 16, wherein said joining means is a resilient member.

20. The invention of claim 19, wherein said resilient member is formed as an integral part of said pedal means and said support means.

* * * * *